US008236139B1

(12) United States Patent
Reed

(10) Patent No.: US 8,236,139 B1
(45) Date of Patent: Aug. 7, 2012

(54) APPARATUS FOR IMPROVING BASIS WEIGHT UNIFORMITY WITH DECKLE WAVE CONTROL

(75) Inventor: David V. Reed, Cincinnati, OH (US)

(73) Assignee: International Paper Company, Memphis, TN (US)

( * ) Notice: Subject to any disclaimer, the term of this patent is extended or adjusted under 35 U.S.C. 154(b) by 418 days.

(21) Appl. No.: 12/494,673

(22) Filed: Jun. 30, 2009

Related U.S. Application Data

(60) Provisional application No. 61/133,483, filed on Jun. 30, 2008.

(51) Int. Cl.
*D21F 1/56* (2006.01)

(52) U.S. Cl. ..... 162/353; 162/351

(58) Field of Classification Search ..... 162/212, 162/297, 310, 315–317, 353
See application file for complete search history.

(56) References Cited

U.S. PATENT DOCUMENTS

| | | | | |
|---|---|---|---|---|
| 1,712,632 | A | 5/1929 | Peterson et al. | |
| 3,928,124 | A | 12/1975 | Hansen | |
| 4,071,193 | A | 1/1978 | Sternby et al. | |
| 4,718,983 | A | 1/1988 | Ibrahim | |
| 4,738,751 | A | 4/1988 | Newcombe | |
| 4,968,387 | A | 11/1990 | Beran et al. | |
| 5,284,551 | A * | 2/1994 | Beran et al. | 162/353 |
| 5,298,127 | A | 3/1994 | Beran | |
| 5,302,250 | A | 4/1994 | Peterson et al. | |
| 6,146,502 | A | 11/2000 | Marx | |
| 6,214,169 | B1 * | 4/2001 | Ruf et al. | 162/212 |
| 6,274,002 | B1 | 8/2001 | Rulis et al. | |
| 6,372,093 | B1 | 4/2002 | Brewer | |
| 6,444,094 | B1 | 9/2002 | Rulis et al. | |
| 6,562,197 | B2 | 5/2003 | Forester | |
| 6,592,721 | B1 | 7/2003 | Anderson et al. | |
| 6,702,926 | B1 | 3/2004 | Egelhof et al. | |
| 6,869,507 | B2 | 3/2005 | Frawley et al. | |
| 2002/0060040 | A1 | 5/2002 | Rulis et al. | |
| 2002/0066546 | A1 | 6/2002 | Forester | |
| 2002/0121354 | A1 | 9/2002 | Aidun | |
| 2003/0116295 | A1 | 6/2003 | Eames | |
| 2003/0188842 | A1 | 10/2003 | Ronnenberg | |
| 2003/0205347 | A1 | 11/2003 | Shead et al. | |
| 2004/0188050 | A1 | 9/2004 | Henssler | |
| 2004/0188051 | A1 | 9/2004 | Juutinen | |
| 2004/0250976 | A1 | 12/2004 | Davis et al. | |
| 2005/0045299 | A1 | 3/2005 | Petschauer et al. | |

(Continued)

FOREIGN PATENT DOCUMENTS

| | | |
|---|---|---|
| EP | 1005588 | 1/2004 |

(Continued)

OTHER PUBLICATIONS

R. Scott Peterson, Improving basis weight uniformity with deckle wave control; Tappi Journal, Jul. 1992, pp. 121-128.

(Continued)

*Primary Examiner* — Eric Hug
(74) *Attorney, Agent, or Firm* — Matthen M. Eslami; Thomas W. Ryan, III

(57) ABSTRACT

An apparatus for preventing the creation of non-uniform profiles caused by deckle waves though the use of transforming the deckle boards into active drainage elements in the paper forming area of the paper machine, without the need for expensive rebuilds such as dilution control head boxes.

5 Claims, 10 Drawing Sheets

U.S. PATENT DOCUMENTS

| | | | | |
|---|---|---|---|---|
| 2005/0086313 | A1 | 4/2005 | Lucas et al. | |
| 2005/0150627 | A1 | 7/2005 | Frawley et al. | |
| 2007/0267162 | A1 * | 11/2007 | Karema et al. | 162/212 |

FOREIGN PATENT DOCUMENTS

| | | |
|---|---|---|
| EP | 1153169 | 2/2004 |
| WO | 03029557 | 4/2003 |
| WO | 2005054574 | 6/2005 |

OTHER PUBLICATIONS

Engineering Research Institute, The University of Michigan Ann Arbor, Final Report, "A Preliminary Study of the Instability of the Stock on the Wire of a Fourdrinier Paper Machine", J.S. McNown, A.C. Spengos, Project 2553, Technical Association of the Pulp and Paper Industry, New York, NY, Sep. 1957.

* cited by examiner

APPARATUS FOR IMPROVING BASIS WEIGHT UNIFORMITY WITH DECKLE WAVE CONTROL

CROSS-REFERENCE TO RELATED APPLICATIONS

The present application claims the benefit of priority under 35 USC §119(e) to U.S. Provisional Patent Application 61/133,483, filed Jun. 30, 2008, which is hereby incorporated, in its entirety, herein by reference.

FIELD OF THE INVENTION

This invention relates to dewatering of stock on the fourdrinier table of a paper machine and more particularly, to eliminate the non-uniformities caused by standard deckle boards while still offering the functionality of preventing the stock from flowing off of the wire in the CD and onto the machine floor.

BACKGROUND OF THE INVENTION

In the manufacture of paper, a stock is deposited onto the moving wire on the Fourdrinier table of a paper machine. The stock which consists of water, fiber, fillers and chemicals; typically the stock contains over 95% water. Deckle boards are needed to prevent the stock from flowing off of the fourdrinier machine. They act as dams, stopping the cross-direction ("CD") flow of the stock. Historically all the designs of paper machine deckles are inactive or static relative to having a function as an active drainage element. They redirect the CD flow of the stock but do not actively drain water from the stock. A byproduct of this damming action is that they create what are known as deckle waves. Deckle waves contribute to non-uniform moisture and basis weight profiles which in-turn contribute to non-uniform caliper profiles. All these sources of non-uniformity can cause rejection of paper or paperboard produced on a fourdrinier type paper machine, resulting in increased costs and production losses.

The present invention solves the problem of creation of non-uniform profiles caused by deckle waves by transforming the deckle boards into active drainage elements in the paper forming area of the paper machine. This addresses the root cause of problem at the point it is created, rather than treating the symptoms further down the paper machine with such things as CD profile equipment, and it solves the problem without the need for expensive rebuilds such as dilution control head boxes.

BRIEF DESCRIPTION OF THE DRAWINGS

A full understanding of the invention can be gained from the following description of the preferred embodiments when read in conjunction with the accompanying drawings in which.

DETAILED DESCRIPTION OF PREFERRED EMBODIMENTS

Figure 1A:
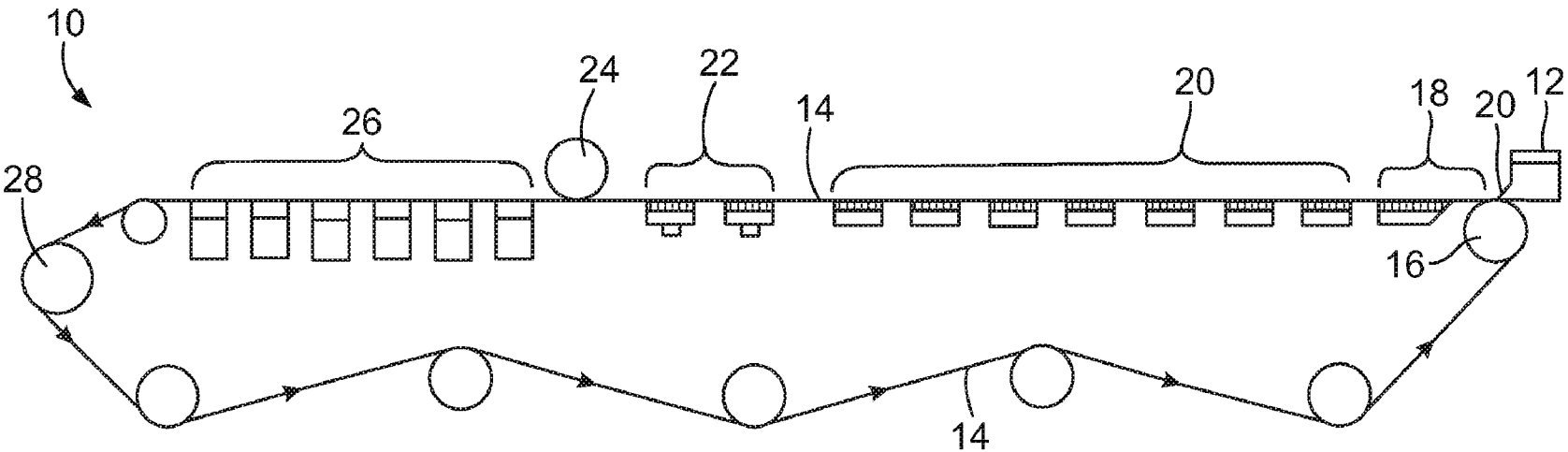
FIG. 1A is a schematic view of typical paper making process machine.

An example of a conventional Fourdrinier table assembly 10 is shown in FIG. 1A. The table 10 includes a head box 12, forming fabric or moving wire 14, a breast roll 16, forming board 18, and a series of gravity foil boxes 20 and vacuum foil boxes 22, a dandy roll 24, a series of suction boxes 26, and a couch roll 28. As the stock suspension moves along the wire 14 and over the foil boxes 20, 22 and suction boxes 26, the water is removed to form a continuous web.

The stock flows out of the head box 12 in a flat stream onto the moving wire 14 on the fourdrinier table of a paperboard machine. At typical operating conditions, the flow stream can be 1 to 2 cm thick and moving at speeds near 1000 fpm. At this point the flow is bounded by the wire underneath, but is open on the edges of the wire and above. Since there is no barrier to flow in the cross machine direction (CD) the stock tends to flow off of the wire and onto the floor. To restrain the CD stock flow, deckle boards (FIG. 1B) are installed on the front and back edges of the fourdrinier machine. These act as dams to restrain the flow. deckle boards also create non-uniformities (waves) in the flow field that lead to non-uniform CD profiles in terms of mass flow and final product properties. Since these non-uniformities (waves) can affect the basis weight profile, it is important to design and set the deckle boards for minimum effect. In addition, these non-uniformities can cause increased operational costs as the papermaker attempts to correct them with other tools further down the paper machine process.

Deckle boards have been made in a variety of shapes which they are within the scope of the present invention. The most advantageous shape is probably a curvilinear shape where in the force of gravity helps to control outward flow of the stock. The profile of the deckle board does not need to be one continuous shape, but can vary as the stock consistency increases along the length of the paper machine fourdrinier.

The design of the deckle needs to accommodate the paper machine wire or forming fabric. It should not induce wear in the wire or cause tearing of the wire. Commonly used materials would be polyethylenes and flouropolymers such as Teflon. Other materials such as ceramics are used on the forming table drainage elements and could be used, although they would be more costly and require additional production steps to produce.

One aspect of the invention is enabling the deckle boards to drain water from the stock, through the wire 14 and off of the forming table 18. The drainage elements could be slots, holes or other shaped openings in the deckle board. The wire prevents fibers from draining through the openings while allowing the water to pass freely.

The drainage of water is accomplished through a hydrofoil type action, where as the wire passes over the opening, water is skimmed from the back side of the wire. This action can be increased by putting a beveled edge on the opening. This increases the efficiency of the hydrofoil activity. This makes the deckle board perform similar to the gravity boxes in early in the fourdrinier.

The draining efficiency of the dynamic deckle boards can be further improved by adding a vacuum box on the outward side of deckle board. This makes the deckle board perform similar to the low and high vacuum boxes in the later sections of the forming section.

Figure 1B:
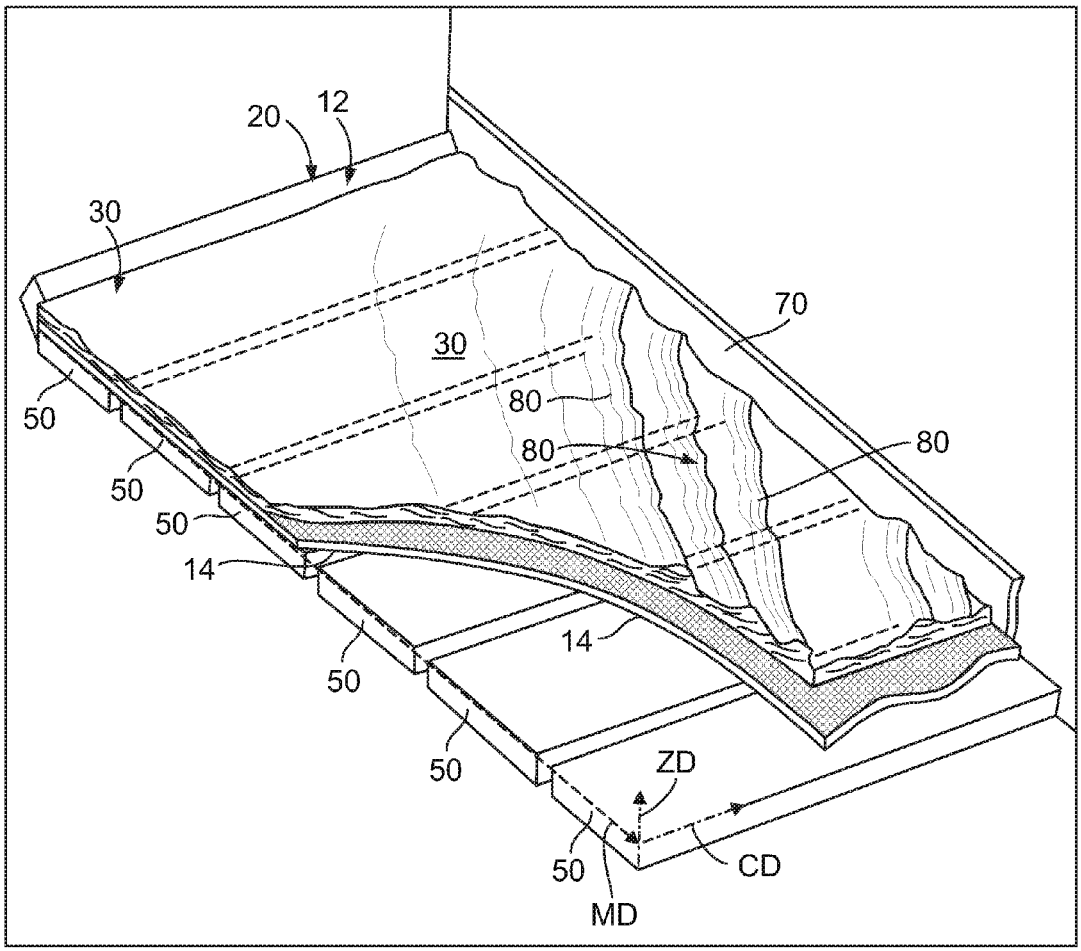
FIG. 1B is a perspective view of a portion of the paper machine showing in FIG. 1A in accordance with the preferred embodiment of the present invention.

FIG. 1B is a perspective view of a portion of the paper machine 10 showing in FIG. 1A. The head box 12 (shown in FIG. 1A), the slice lip 20 (shown in FIG. 1A), and the stock 30 flowing from the slice lip 20, onto the wire 14. The stock is typically greater than 95% water, and usually greater than 99% water, with the remaining portion being pulp. As the stock is carried by the moving wire it passes over the table drainage elements 50. These are a variety of different types of drainage elements such as gravity boxes, low vacuum boxes, high vacuum boxes, all generally being types of hydrofoils designed to drain water from the stock. The water is removed through drainage elements 50.

On the Cross Machine Direction (CD) edge of the paper machine there is typically a deckle board 70 designed to prevent the stock from flowing off of the wire onto the floor or into the wire pit. No water drains through the deckle boards so the concentration of stock near the deckle boards is slightly higher than across the rest of the machine in the CD. While shown as a single piece, some machines have multiple deckle boards joined together to form a continuous wall in the MD.

Since the deckle board 70 is stationary and the wire 14 and stock 30 are moving at the same speed in the machine direction (MD), there is also a drag against the stock as it moves past the stationary deckle board 70. The combination of lack of drainage into the deckle board 70 and the drag against the deckle board 70 cause excess water and stock to build in the area of the deckle boards 70. The build up of stock and water against the deckle board 70 eventually reaches a large enough volume that it creates a flow in the CD towards the center of the paper machine that starts the formation of a deckle wave 80.

Figure 2:
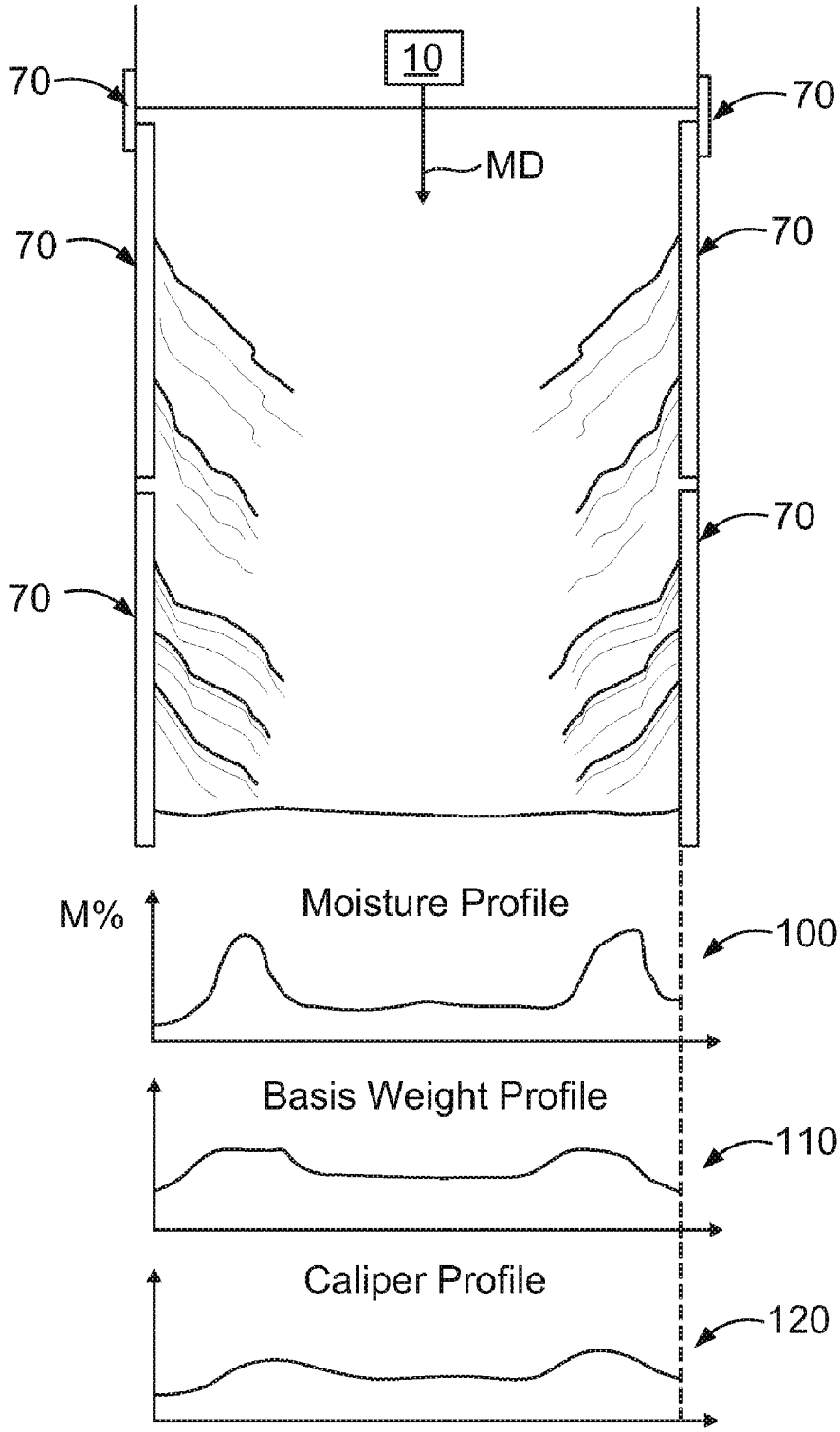
FIG. 2 is an illustrated representation of a deckle wave continuing flowing towards the center of the machine in accordance with the present invention.

FIG. 2 illustrates that the deckle wave continues flowing towards the center of the machine until sufficient MD downstream drainage removes additional water from the area cutting off the CD flow as the web solidifies. While the wave is no longer visible further down the MD, the impact of this CD flow can been seen all the way down the rest of the paper machine. Because paper making is not a steady state process, the imparting of extra moisture or extra fiber by the CD flow of the stock can result in CD non-uniformities in the moisture profiles 100, the basis weight profiles 110, and thickness profiles 120. The degree to which the CD profile variability's are exhibited depend strongly on how much CD profiling equipment is installed on the paper machine to correct for the non-uniformities created by the head box and the forming sections.

Figure 3:
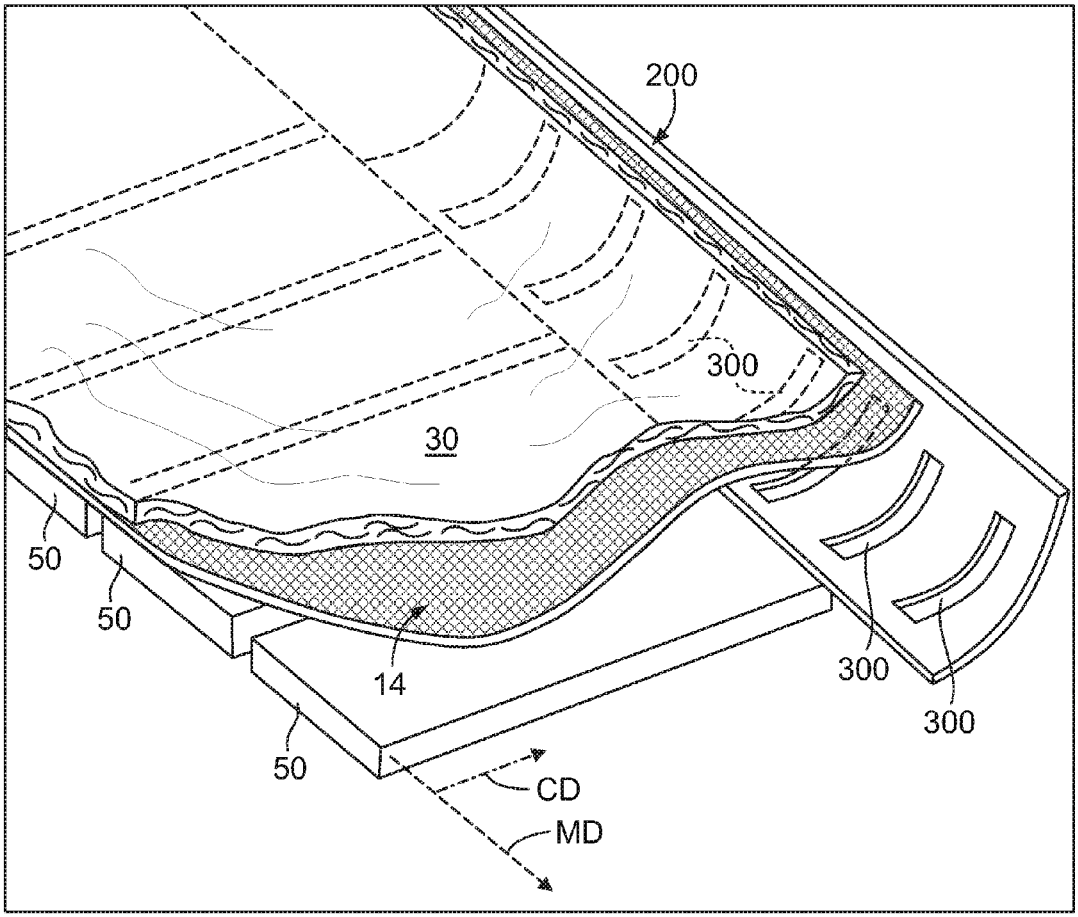
FIG. 3 is a perspective view of a dynamic deckle that includes drainage elements in accordance with the present invention.

FIG. 3 is a standard deckle board 70 has been replaced with a dynamic deckle 200 that includes drainage elements 300. These drainage elements 300 allow water from the stock 30 to pass through the wire 14 and off of the paper forming table 18. By removing the water from the stock through the dynamic deckle 200 at the same rate it is removed by the table elements 18, there is no excess water present to cause a deckle wave. Additionally since the stock 30 does not contact a non moving deckle board 70, there is no drag against the stock 30. The lack of drag coupled with the drainage water through the dynamic deckle board result in more uniform CD profiles for moisture, basis weight and caliper.

FIG. 4 illustrate that the drainage can be accomplished with a variety of configurations, dependent upon the needs of the machine, the type of wire and the type of stock. FIG. 4*a* shows an evenly spaced series of slots 40. FIG. 4*b* has non-uniformly spaced slots 40 and in FIG. 4*c* the slots are angled. The width of the slots does not have to be uniform. This non-uniform design could be for a structural purpose or to provide differential drainage rates through the deckle.

Figure 4A:
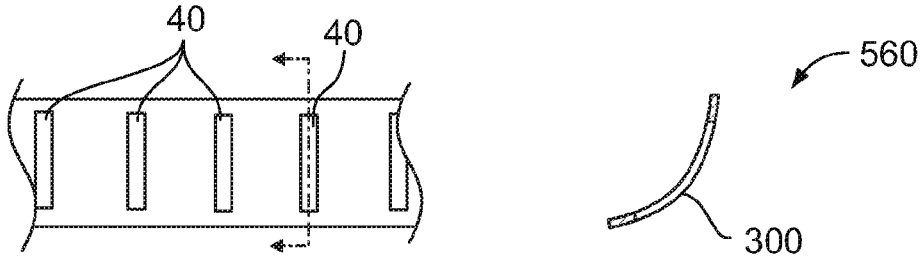
FIGS. 4A-4F illustrates a variety of configurations of the instant invention, dependent upon the needs of the paper machine, the type of wire and the type of stock.
Figure 4B:
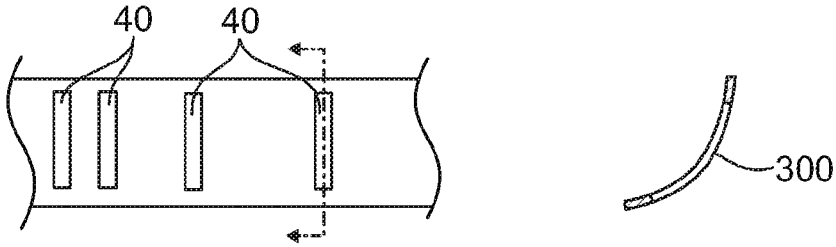
Figure 4C:
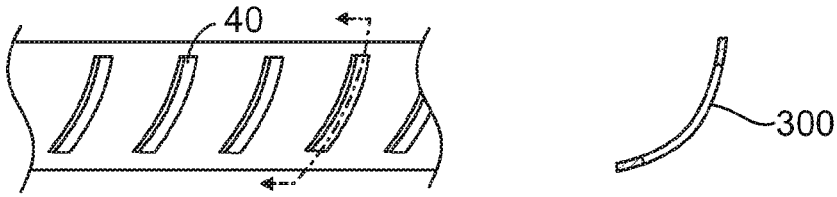
Figure 4D:
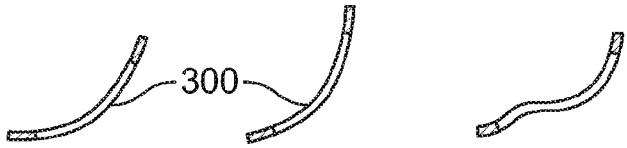

FIG. 4*d* is a cross section view of the dynamic deckle and shows that the profile can be circular, hyperbolic, parabolic or combination of any sort of geometric curves. Although not showing, there are attachments and mounting options wherein the dynamic deckle 200 can be attached to the framework of the paper machine 10.

Figure 4E:
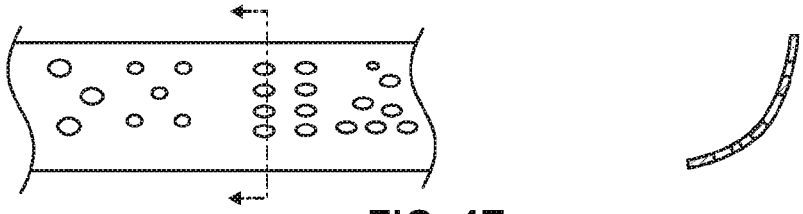

FIG. 4*e* shows the slots can be replaced with holes. While slots would need to be cast or machined into the deckle, the holes could be drilled. The ends of slots could be rounded to aid in manufacturability.

Figure 4F:
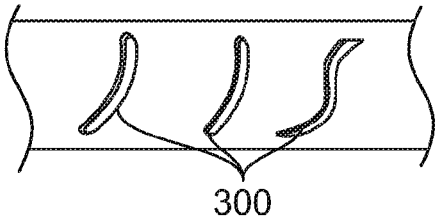

FIG. 4*f* shows the drainage holes in the dynamic deckle can be other than straight or round.

Figure 5:
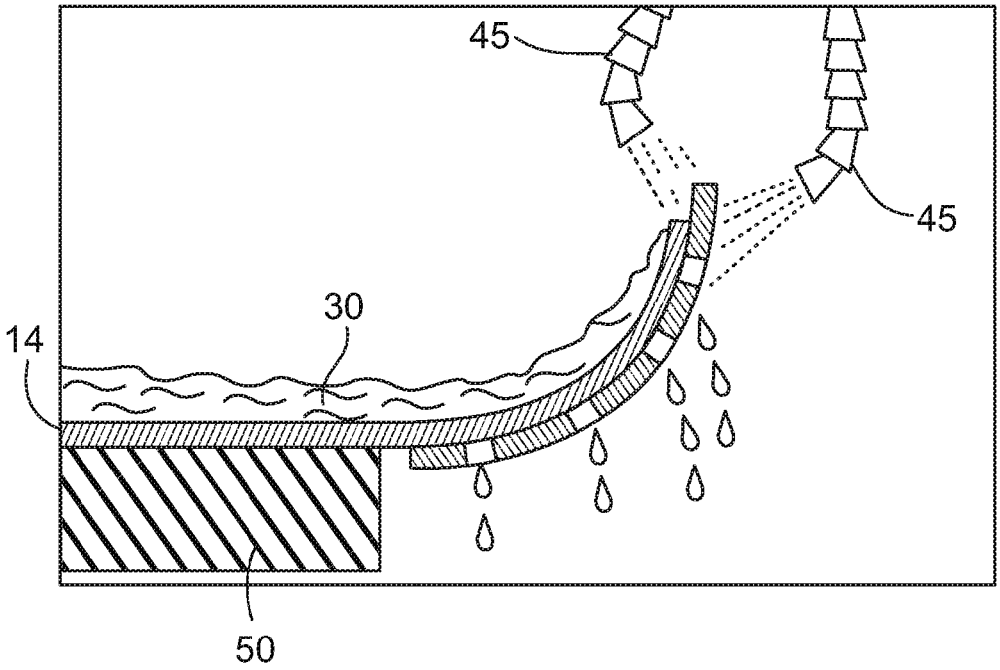
FIG. 5 is a cross-sectional view showing alternative drainages with showers installed to wash any stock off of the dynamic deckles to prevent it from building up in accordance with the present invention.

FIG. 5 shows alternatives with showers 45 installed to wash any stock off of the dynamic deckles to prevent it from building up. The preferable material will be such that it does not create wear to the paper machine wire 14. The material should also be resistant to paper machine chemicals and should not allow the fibers in the stock to adhere easily to the deckles.

Figure 6:
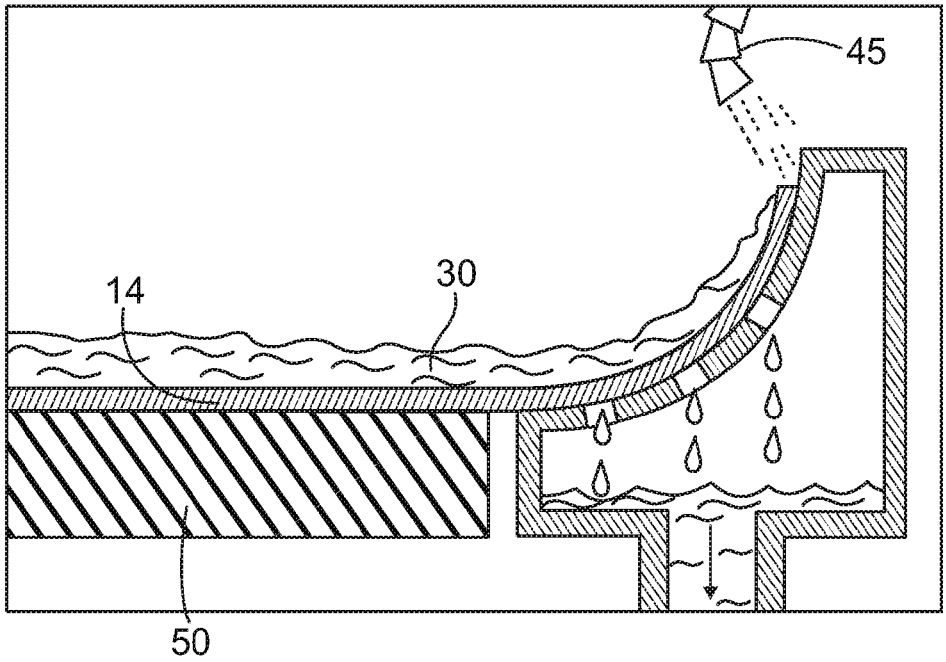
FIG. 6 is a cross-sectional view showing a dynamic deckle attached to a vacuum system to increase the flow rate of water from the stock through the wire in accordance with the present invention.

FIG. 6 shows that the dynamic deckle 200 can be attached to a vacuum system to increase the flow rate of water from the stock through the wire.

Figure 7:
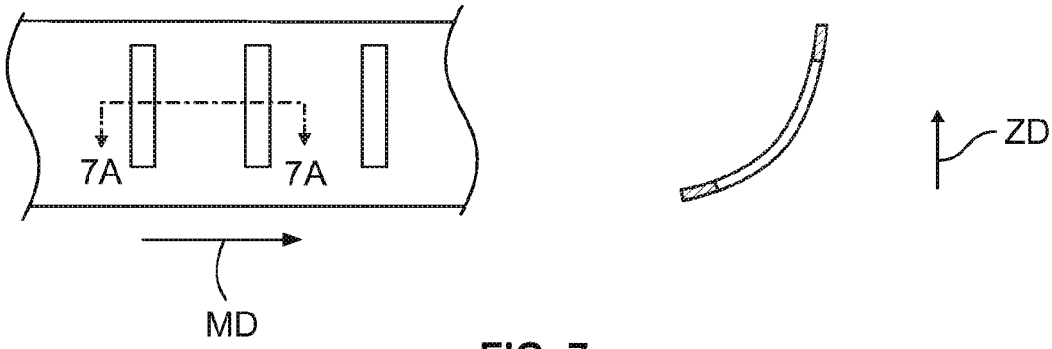
FIG. 7 is a cross section view of the dynamic deckle and shows that the slots do not have to be orthogonal to the surface.
Figure 7A:
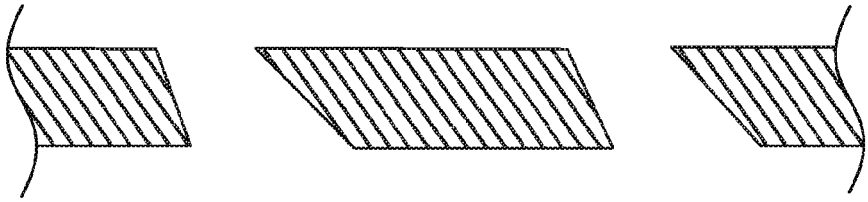

FIG. 7 is a cross section view of the dynamic deckle and shows that the slots do not have to be orthogonal to the surface. It is preferable that the slots have some angle to them to assist in hydrodynamic water removal from the stock. The angles can be equal or non-equal and can vary down the length of the machine.

Figure 8:
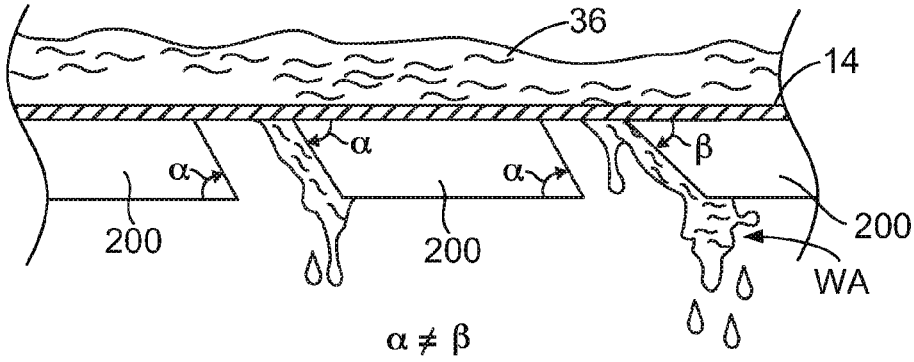
FIG. 8 is a cross-sectional view showing the water removal from the stock, through the wire.

FIG. 8 shows the water removal from the stock, through the wire. There could be vacuum applied as in FIG. 6 to increase the rate of water removal and thereby prevent the formation of deckle waves.

Figure 9:
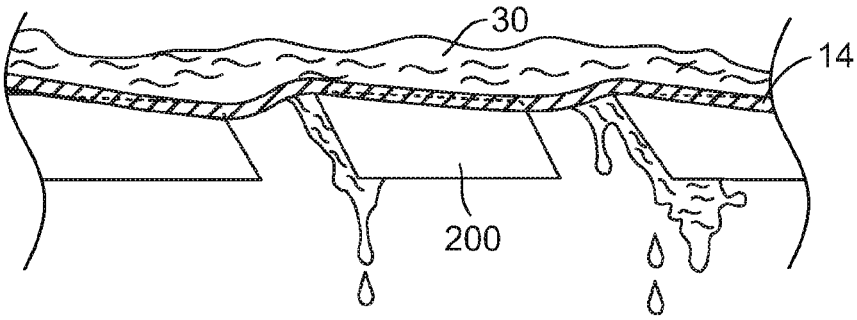
FIG. 9 is a cross-sectional view showing that there can be additional geometries on the top or bottom surfaces of the dynamic deckle to enhance water removal from the stock, in accordance with the present invention.

FIG. 9 shows that there can be additional geometries on the top or bottom surfaces of the dynamic deckle to enhance water removal from the stock.

FIG. 10 shows a top view of a paper machine fourdrinier. During each interval of time a unit of stock 30 is pumped out of the headbox 12 and onto the wire 14. The stock exits the headbox 12 through the slice lip 20 and is deposited onto the moving wire. The speed of the jet and the speed of the wire can be adjusted independently and for simplicity, it considers the case where the jet and wire are running at the same speed.

This would be analogous to running at zero rush or drag. Rush and drag being the relative speeds of the jet to wire ratio.

In a zero rush or zero drag condition there would be no relative MD flow of the stock 30 across the moving wire 14. So the "no slip" boundary condition for fluid flow would be satisfied. If it is assumed that the deckle boards 70 are frictionless, then there would be no drag along the sides. This would result in a uniform velocity profile down the length of the fourdrinier.

Figure 10A:
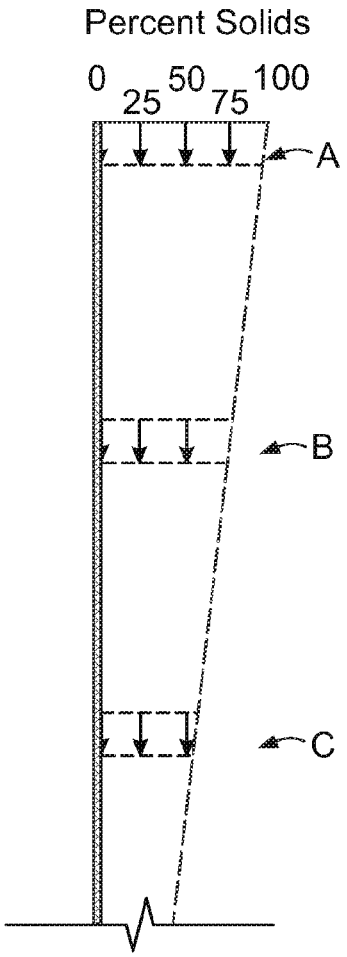
FIGS. 10A-10B shows a top view of a paper machine fourdrinier.

The graph at the right side of FIG. 10A shows the percent solids of the stock on the wire. The wire is moving past various water removal devices commonly installed on paper machine fourdrinier such as gravity boxes, low vacuum boxes, high vacuum boxes, hydrofoils and any other devices normally found on fourdrinier machine. These devices are designed to aid in removal of water from the stock. As the water is removed the percent of solids increases down the length of the table in the MD.

For good papermaking the water removal should be uniform down the length of the fourdrinier (or table). If the rate of water removal is not uniform in the CD, then the web will have non-uniform moisture profiles that can contribute to breaks in the downstream operations. The web leaves the fourdrinier at the couch roll somewhere close to 40% solids. Solids are the percent of fiber and filler in the web. The wire typically a woven material is designed with small holes designed to maximize the retention of solids in the web and to maximize the drainage of water from the stock.

Figure 10B:
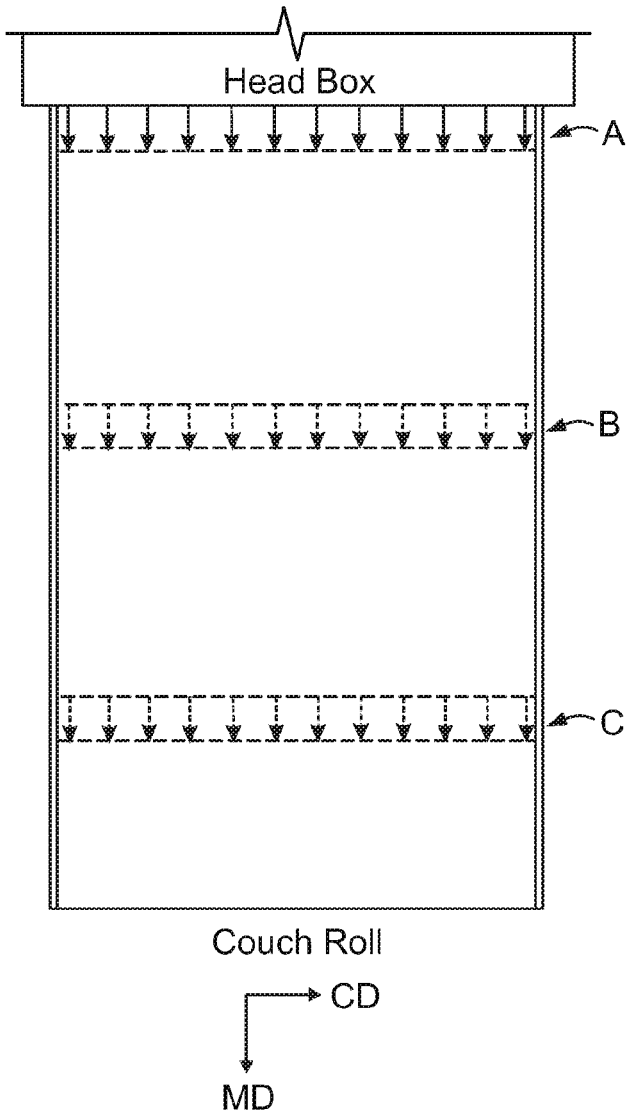
Figure 11A:
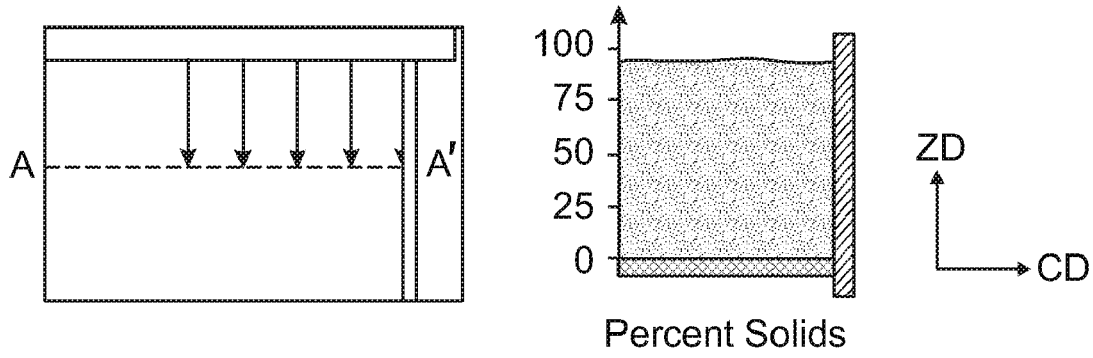
FIGS. 11A-11C illustrate close-up views of areas A, B and C from FIG. 10A-B, along with charts illustrating the impact of drag caused by the stock flowing next to a deckle board.
Figure 11B:
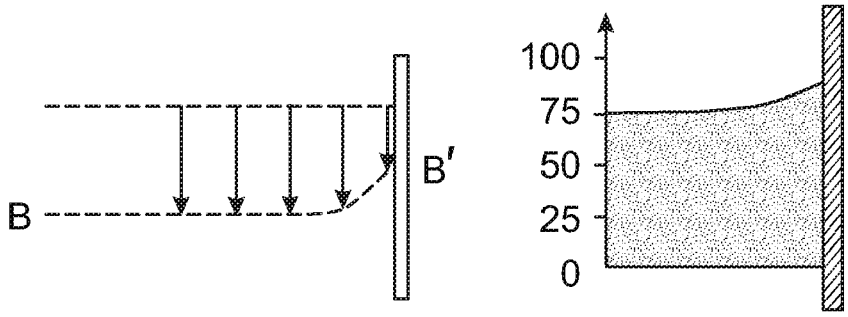
Figure 11C:
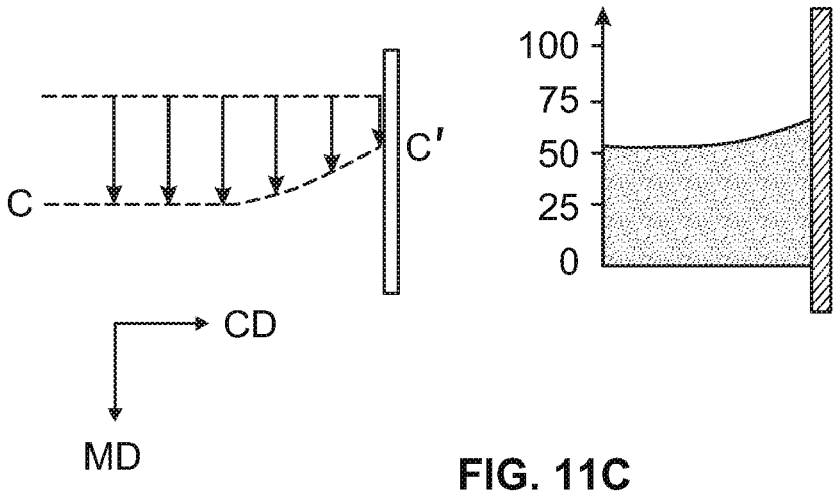

FIGS. 11A-11C is a closer view of areas A, B and C from FIGS. 10A-B, but is shown this time with the impact of drag caused by the stock flowing next to a deckle board. In FIG. 10, the deckle board was assumed to be frictionless. Since practically, it can not be frictionless then there is a drag exerted on the stock. An ordinary skill in the art knows that any time a fluid is in contact with a material the "No Slip" boundary condition must be satisfied. For a zero rush and zero drag condition, the wire and stock are moving at the same speed. The deckle board is stationary. To satisfy the No-Slip boundary condition the stock in contact with the deckle board must also have zero velocity in the MD.

FIGS. 11A, 11B and 11C show on the right side the impact of the No-Slip boundary condition on the flow of stock. As the wire transports the stock down the fourdrinier in the MD, the drag of the stock on the deckle board causes the stock near the deckle board to slow. This causes both the solids near the deckle board to increase and the mass of stock concentrated near the deckle boards to increase.

When the difference in mass near the deckle board becomes large enough it will start to flow back towards the center of the paper machine. Since the liquid can not be stacked, therefore the free surface seeks equilibrium at an equal height. This height will be the lowest height possible given a certain volume of fluid. This flow away from the deckle boards in the CD toward the center of the fourdrinier machine is the cause of deckle waves.

Some paper makers have attempted to solve this by using curved deckle boards so the wire is curved up and the stock does not contact a stationary object. This still results in deckle waves, because the curved up wire is not in contact with the water removal devices of the fourdrinier. This then does not allow drainage of the stock through the wire and still results in a build up of mass at the edges of the wire. When this mass build up gets large enough it will flow in the CD away from the deckle edges and result in the formation of deckle waves.

Figure 12:
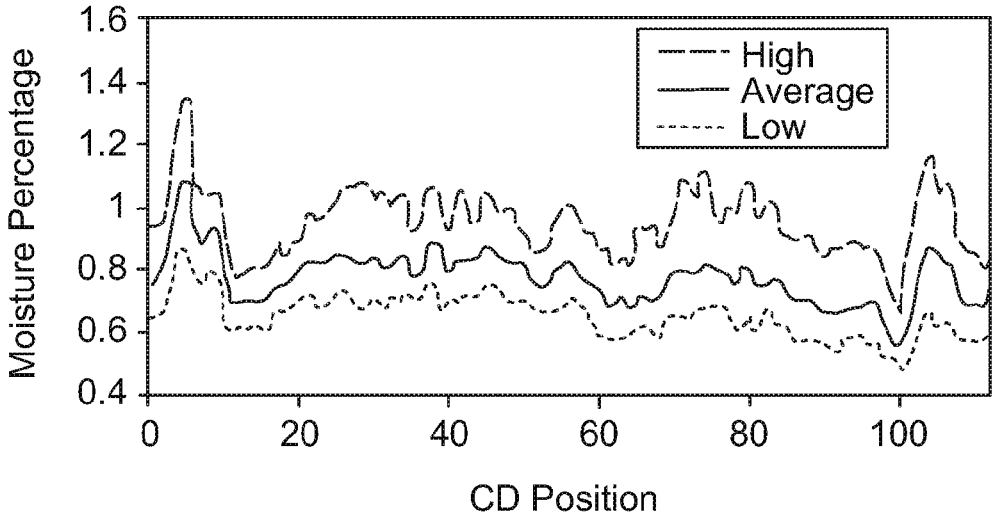
FIG. 12 is a graph of a paper machine moisture profile.

FIG. 12 is an actual paper machine moisture profile. On the left and right edges two moisture spikes can be seen. These two spikes correspond to the CD locations of the deckle waves on the fourdrinier. FIG. 12 is a paper machine moisture profile showing impact of deckle waves.

Figure 13:
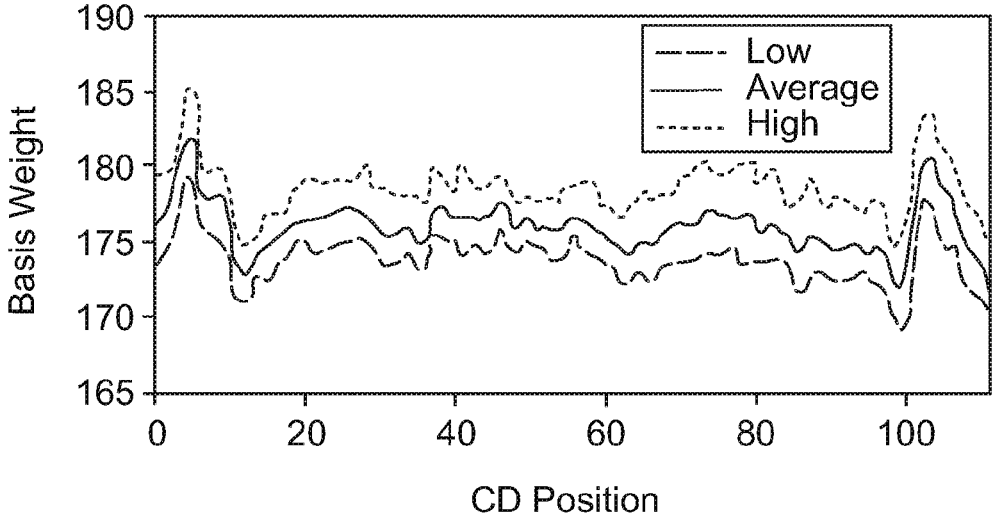
FIG. 13 a graph of basis weight profile showing basis weight spikes near the cross-directional locations of the deckle waves

FIG. 13 shows the same paper machines basis weight profile. This shows that the deckle waves impact the basis weight profile as well as the moisture profile. A dynamic deckle mechanism that prevents the formation of deckle waves will improve both the basis weight and moisture profiles. The calendaring operations tend to smooth out the caliper variations caused by the deckle waves, but due to the greater amounts of moisture and fiber in these areas this can result in non-uniform gloss and non-uniform porosity.

Since all paper machine operations are non-steady state or may equally be called transient, if non-uniformity develops at an upstream position it tends to pass through all the subsequent downstream operations. So when deckle waves cause non-uniformity in the mass distribution on the fourdrinier, this non-uniformity tends to remain in the paper or paperboard all the rest of the way down the paper machine.

Some paper machines have attempted to address these non-uniformities by adding top wires or dandy rolls to the fourdrinier. This can help but not fully overcome non-uniformities introduced by deckle waves.

While the invention has been described with reference to a preferred embodiment, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An apparatus for dewatering of stock on a fourdrinier table of a paper machine comprising:

at least one deckle board having a plurality of openings to remove water from the fourdrinier table and to eliminate deckle waves therefrom wherein the plurality of openings being selected from a group consisting of non-uniformly spaced slots, uniformly spaced slots and angled slots.

2. The apparatus of claim 1 wherein said deckle board has across-sectional profile selected from the group consisting of a circular profile, a hyperbolic profile, and a parabolic profile.

3. The apparatus of claim 1 wherein said deckle board openings are apertures.

4. The apparatus of claim 1 further comprising a vacuum box connected to said deckle board.

5. The apparatus of claim 1 wherein said at least one deckle board is constructed of a material selected from the group consisting of polyethylenes, flouropolymers, and ceramics.

* * * * *